United States Patent [19]

Burkdoll

[11] 4,209,823

[45] Jun. 24, 1980

[54] PYROTECHNIC LIGHT SOURCE

[75] Inventor: Frank B. Burkdoll, Fairfield, Calif.

[73] Assignee: Explosive Technology, Inc., Fairfield, Calif.

[21] Appl. No.: 930,181

[22] Filed: Aug. 2, 1978

[51] Int. Cl.[2] ..... F21V 9/16

[52] U.S. Cl. ..... 362/84; 102/37.8; 149/2; 362/171

[58] Field of Search ..... 362/34, 84; 102/37.8; 149/2

[56] References Cited

U.S. PATENT DOCUMENTS

| | | | |
|---|---|---|---|
| 3,474,730 | 10/1969 | Sheeran | 149/2 X |
| 3,774,022 | 11/1973 | Dubrow et al. | 362/34 |

*Primary Examiner*—Stephen J. Lechert, Jr.

*Attorney, Agent, or Firm*—Flehr, Hohbach, Test, Albritton & Herbert

[57] ABSTRACT

Light source utilizing pyrotechnic and phosphorescent materials to provide a sustained glow or light. The device includes an elongated tubular casing of light transmissive material, a core of pryotechnic material within the casing, and a phosphorescent material in the wall of the casing which is activated by light produced in ignition of the pyrotechnic material.

11 Claims, 2 Drawing Figures

FIG-1
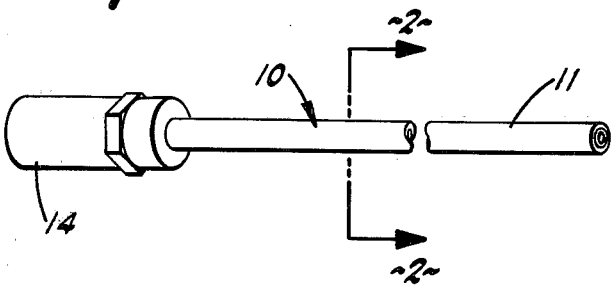
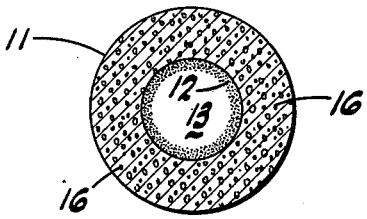
FIG-2

PYROTECHNIC LIGHT SOURCE

BACKGROUND OF THE INVENTION

This inventions pertains generally to light sources and more particularly to a light source utilizing pyrotechnic and phosphorescent materials to provide a sustained visable light.

The invention has particular utility in emergencies and other situations where electricity and other sources of energy are not available. In an airplane, for example, the invention can be utilized to guide passengers to exits in the event of a crash or other emergency where normal lighting is not available.

SUMMARY AND OBJECTS OF THE INVENTION

The light source of the invention comprises an elongated tubular casing of light transmissive material, a core of pyrotechnic material within the casing for burning with a rapid light-producing reaction when ignited, and a phosphorescent material activated by the light produced by the ignition of the pyrotechnic material for maintaining a sustained glow which is visable externally of the casing.

It is in general an object of the invention to provide a new and improved light source.

Another object of the invention is to provide a light source of the above character utilizing pyrotechnic and phosphorescent materials.

Another object of the invention is to provide a light source of the above character which can be utilized in emergencies and other situations where electricity and other sources of energy are not available.

Additional objects and features of the invention will be apparent from the following description in which the preferred embodiment is set forth in detail in conjunction with the accompanying drawings.

BRIEF DESCRIPTION OF THE DRAWINGS

FIG. 1 is a fragmentary perspective view, of one embodiment of a light source according to the invention.

FIG. 2 is an enlarged cross-sectional view taken along line 2—2 in FIG. 1.

DESCRIPTION OF THE PREFERRED EMBODIMENT

As illustrated in the drawings, the light source is made in the form of an elongated cord 10 having an elongated tubular casing 11. The casing is fabricated of a light transmissive material such as a suitable plastic and can be either rigid or flexible and of any desired length. It is preferably made of a material which will withstand an internal ignitive reaction without rupturing, and one suitable material is an ionomer resin such as the material marketed by DuPont under the trademark Surlyn. The casing can have any desired diameter and wall thickness, and one presently used tubing has an outside diameter of ⅛ inch and an inside diameter of 1/16 inch.

A core of pyrotechnic material 12 is provided within the casing. In the embodiment illustrated, the core is formed as a layer or coating on the inner wall of the casing. A gas channel 13 extends longitudinally of the casing adjacent to the pyrotechnic material. The pyrotechnic material can be any suitable such material which burns with a rapid, light producing reaction. One suitable material consists of a mixture of 34% potassium perchlorate, 34% ammonium perchlorate and 32% aluminum powder by weight. The pyrotechnic material is preferably selected to provide a light output of the optimum wavelength for excitation of the phosphorescent material with which it is used. With a casing having an internal diameter of 1/16 inch, satisfactory results have been obtained with a core load of about 7 mg. of pyrotechnic material per linear foot of casing.

Gas channel 13 serves to support the ignitive reaction or shock wave as it travels along the cord. The actual speed depends upon factors such as the nature of the pyrotechnic material and the dimensions of the casing and gas channel, but the reaction typically travels at a speed on the order of 1000–2000 meters per second.

In the preferred embodiment, the pyrotechnic material is percussively ignited, and a percussive primer cap 14 is connected one end of the device for this purpose. The other end of the casing or tube is preferably closed to prevent noise when the device is fired. However, if desired, other types of primers can be employed, and the distal end of the tube can be left open.

Particles of phosphorescent material 16 are embedded in the wall of casing 11. The phosphorescent material is activated or excited by the light produced by the ignition of the pyrotechnic material, and once activated, the phosphorescent material provides a sustained glow or light. The phosphorescent material is selected to provide the desired characteristics, such as persistence. Any suitable material can be employed, and one presently preferred material is zinc sulfide.

The phosphorescent material is admixed with the plastic material during the manufacture of the casing. The amount of phosphorescent material is dependent upon the characteristics of the material and the application for which the device is to be used, and the amount of phosphorescent material in the casing is typically on the order of 10% or less, with particularly satisfactory results having been obtained with less than 5% by weight.

In operation and use, the cord is installed wherever light is desired. For example, the cord can be mounted on the cabin walls of an aircraft to outline or lead to emergency exits, or it can be formed into letters or characters for signs. When ignited, the pyrotechnic material burns with a rapid ignitive reaction, giving off a bright flash of light. This light activates the phosphorescent material which then provides a sustained light or glow.

It is apparent from the foregoing that a new and improved light source has been provided. While only one presently preferred embodiment has been described, as will be apparent to those familiar with the art, certain changes and modifications can be made without departing from the scope of the invention as defined by the following claims.

I claim:

1. A pyrotechnic light source comprising: an elongated tubular casing of light transmissive material capable of withstanding an internal ignitive reaction without rupturing, a core of pyrotechnic material within the casing for burning with a rapid light producing reaction when ignited, and a phosphorescent material activated by the light produced by the ignition of the pyrotechnic material for maintaining a sustained glow which is visable externally of the casing after the burning reaction is completed.

2. The light source of claim 1 wherein the core of pyrotechnic material is formed as a coating on the inner wall of the casing.

3. The light source of claim 1 or 2 further including a gas channel extending longitudinally of the casing and adjacent to the coating of pyrotechnic material for supporting the ignitive reaction of said material.

4. The light source of claim 1 wherein the pyrotechnic material is percussively ignited.

5. The light source of claim 1 wherein the phosphorescent material is embedded in the wall of the casing.

6. The light source of claim 5 wherein the casing is fabricated of a plastic material containing on the order of 5% of the phosphorescent material by weight.

7. A light source comprising: an elongated tubular casing capable of withstanding an internal ignitive reaction without rupturing and having a phosphorescent material embedded in the wall thereof, and a core of pyrotechnic material within the casing for burning with a rapid light producing reaction to activate the phosphorescent material to provide a sustained glow which is visable through the wall of the casing after the burning reaction is completed.

8. A pyrotechnic light source comprising: a pyrotechnic material which burns with a rapid, light-producing reaction when ignited, and a phosphorescent material activated by the light produced by the pyrotechnic material for emitting a visible light which persists after the burning reaction is completed.

9. A pyrotechnic light source comprising: a light transmissive casing capable of withstanding an internal ignitive reaction without rupturing, a core of pyrotechnic material within the casing for burning with a rapid, light producing reaction when ignited, and a phosphorescent material carried by the casing and activated by the light produced by the pyrotechnic material for emitting and illuminating light which persists and is visable through the wall of the casing after the burning reaction is completed.

10. The light source of claim 9 wherein the pyrotechnic material is embedded in the wall of the casing.

11. The light source of claim 9 wherein the core of pyrotechnic material is formed as a coating on the inner wall of the casing, with a gas channel adjacent to the coating for supporting the burning reaction.

* * * * *